United States Patent [19]

Shingo

[11] 4,304,561

[45] Dec. 8, 1981

[54] FILM FOLDING DEVICE

[75] Inventor: Hiromichi Shingo, Yokohama, Japan

[73] Assignee: Toyo Shokuhin Kikai Kabushiki Kaisha, Yokohama, Japan

[21] Appl. No.: 38,912

[22] Filed: May 14, 1979

[30] Foreign Application Priority Data

Sep. 18, 1978 [JP] Japan ..... 53-114308
Oct. 20, 1978 [JP] Japan ..... 53-129723

[51] Int. Cl.[3] ..... B65H 45/22

[52] U.S. Cl. ..... 493/439; 493/269; 493/447; 493/456

[58] Field of Search ..... 270/86, 93, 94; 493/446–447, 455–456, 369, 438–440

[56] References Cited

U.S. PATENT DOCUMENTS 229,479 6/1880 Scholfield ..... 270/94
1,717,120 6/1929 Richardson ..... 270/86
2,094,866 10/1937 Aeschbach ..... 270/86
2,362,771 11/1944 Remington ..... 270/94
2,730,357 1/1956 Deichmann ..... 270/86
2,900,934 8/1959 Judelson ..... 270/86

*Primary Examiner*—Edgar S. Burr
*Assistant Examiner*—A. Heinz
*Attorney, Agent, or Firm*—Donald D. Mon

[57] ABSTRACT

Film running one direction is folded along a longitudinal folding line by a folding plate and folding blade. The folding plate has a front edge and an inclined edge extending in the lateral direction against the film feeding direction, the folding blade extending in an oblique direction against the film feeding direction from the apex point of said edges of the folding plate for folding the outer part of a film against the reverse side of the film. The edges of the folding plate receives the tensile force of the film along the whole width so as to avoid any concentration of tensile force.

7 Claims, 12 Drawing Figures

FILM FOLDING DEVICE

BACKGROUND OF THE INVENTION

This invention relates to a film (sometimes called "plastic sheet") folding device for a film winding machine, film slitter, film bag manufacturing machine, etc. and more particularly, this invention relates to a device for folding thin film which is running one direction, in U shape or C shape in cross section along a longitudinal line.

In one prior device, as shown in FIG. 10, film 2 (sometimes called plastic sheet) is fed in an inclined upward direction from feed roller 1, folding roller 3 is inserted at reverse side of film 2 at folding line 2*a*, and folding bar 5 is provided above the folding roller 3 for folding outer part 2*b* along folding line 2*a* on the reverse side of folding plate 4. Roller 6 is a secondary feeding roller. If the end 3*a* of folding roller 3 were a point, the folding would be performed precisely, however, the tensile force of the film is concentrated at point 3*a*, and can cause an injury and resulting rupture. For avoiding the concentration of tensile force, the configuration of the end 3*a* should be a sphere or a similar shape to a sphere. In practice, however, it causes an error in folding and the concentration of the tensile force can not be avoided perfectly. The error of folding is modified at the edge 4*a* of the folding plate 4, however, the part of the film folded by the end 3*a* of a folding roller 3 remains, and the remaining folded part disappears in the case of resilient film such as polyethylene film. However, in the case of less resilient film such as stretched polypropylene film (DPP) or cast polypropylene film (CPP), or paper, the remaining folded part becomes permanently creased 1*c*, 1*c*, . . . and harms appearance.

For avoiding said concentration of tensile force on the film, there is an apparatus for folding film by triangle plate.

FIG. 11 shows a prior art half folding device using a triangle plate, in which film 2 is fed to a triangle plate 7, the folded film 2*x* at the under part of triangle plate 7 being fed in a lateral direction. However, this widens the occupying area of the apparatus because the delivering direction of the film 2 must make a right angle to the feeding direction of the film 2. Moreover in the case of film of uneven thickness, it is difficult to adjust the angle of triangle plate 7 which is necessary to prevent the production of a crease in film. When the film to be folded in half is substituted for a half size film 8 in width such as inflation film in a prior device as shown in FIG. 12, film 8 runs at an inclined edge to triangle plate 7, making it useless to try to prevent a crease in the film. Moreover, if the film 8 slips at the inclined edge of triangle plate by the length $e_1$, the position of delivering film 8 is offset by the length $d_1$, and such a variation of the position of the film 8 produces an error in the operation of a photo electrical film detecting device hole punch, gusset insertion device, slitter etc. in a bag manufacturing device of a slitter etc.

BRIEF SUMMARY OF THE INVENTION

The primary object of the present invention is to provide a film or sheet folding device in which film contacts the front edge and inclined edge of a folding plate so as to distribute the tensile force of the film and folding the film at the contact with the edge of folding blade so as to avoid the concentration of tensile force so that film is folded accurately and precisely without producing a crease injuring the film.

The secondary object of present invention is to provide a film folding device in which the delivering direction of the film is the same as the feeding direction of the film so that the occupying area of the device is reduced and the film may substituted for a half size film such as a tubular inflation film easily without causing any trouble.

Other objects and advantages will be come apparent from the following description with accompanying drawings.

DETAILED DESCRIPTION OF THE INVENTION

Figure 1:
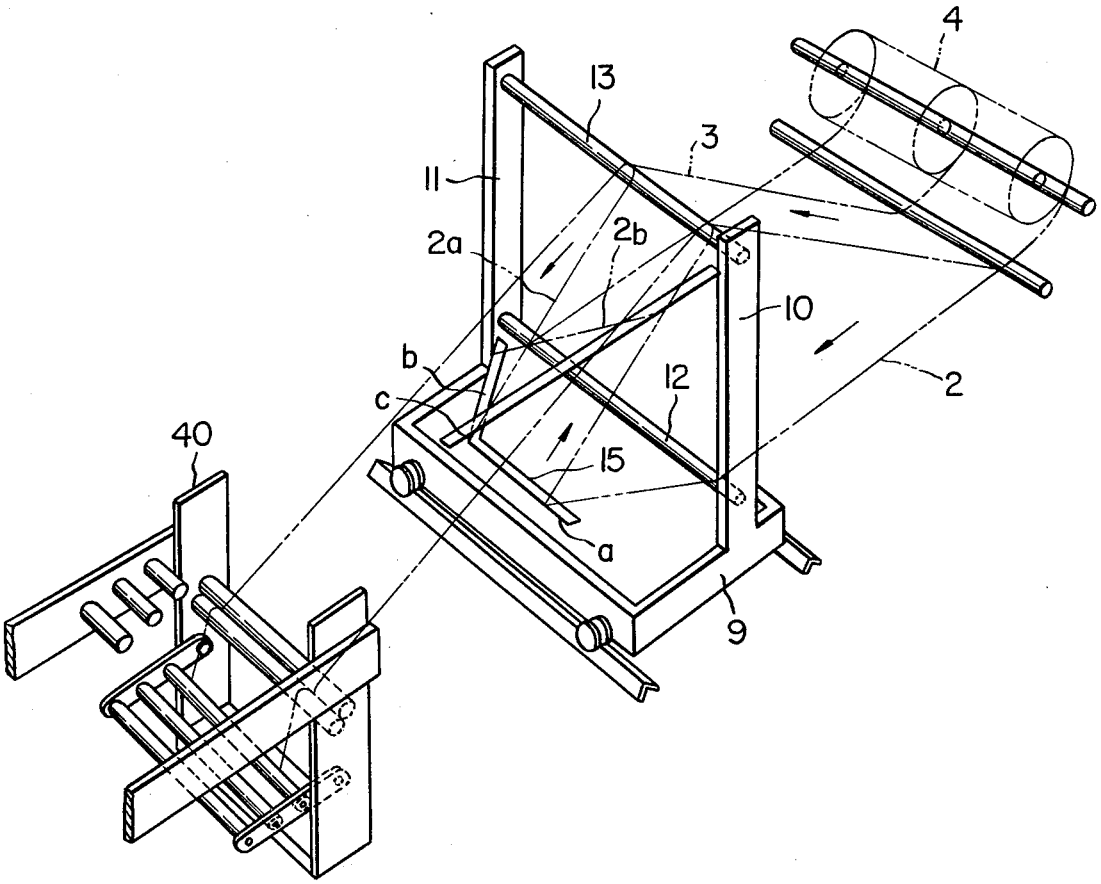
FIG. 1 is a perspective view of an embodiment of the present invention.
Figure 2:
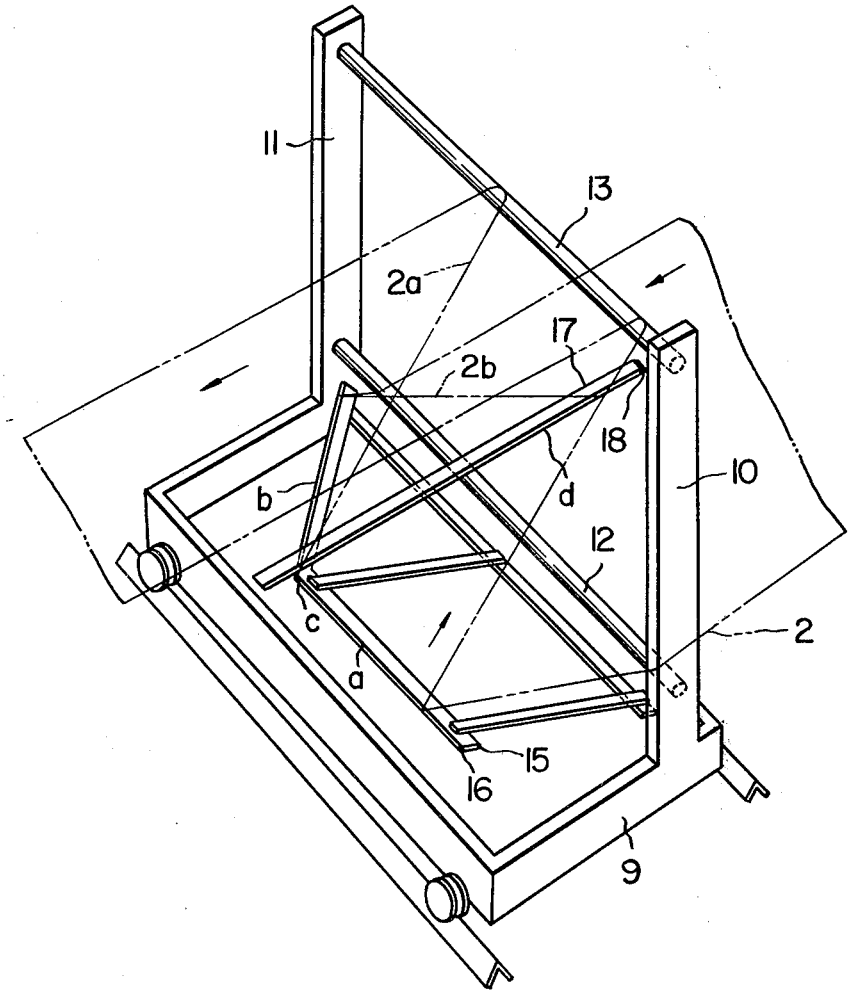
FIG. 2 is an enlarged perspective view of the embodiment shown in FIG. 1.
Figure 3:
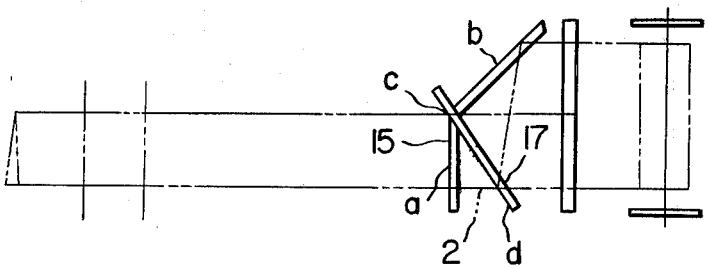
FIG. 3 is a plan view of the embodiment of FIG. 1 showing essential parts only.

As shown in FIGS. 1, 2, a pair of struts 10, 11 are provided on a base 9 at the opposite sides of a film 2 which is fed from a film roll 4. The first and second film guide rollers 12, 13 are provided between struts 10, 11. A film folding plate 15 is fixed in front of the first film guide roller 12 and extends in an oblique upward direction from this guide roller. As shown in FIG. 3, said folding plate 15 has a front edge "a" extending in a lateral direction and inclined edge "b" extending in an oblique rearward direction with the apex point c of said edges a, b forming an obtuse angle opposing a center line (i.e. folding line 2*a*). A round edge 16 is formed at the lower part of said edges a, b.

As shown in FIG. 1, 3, folding blade 17 is fixed at the reverse side of the film 2, the folding blade 17 extends along the reverse face of the film 2 which extends in an oblique upward direction. Moreover the folding blade 17 is inclined against the feeding direction of the film 2. Therefore the side edge "d" of the folding blade 17 extends in an upward oblique direction with round edge 18 formed at lower part of the edge d.

Figure 4:
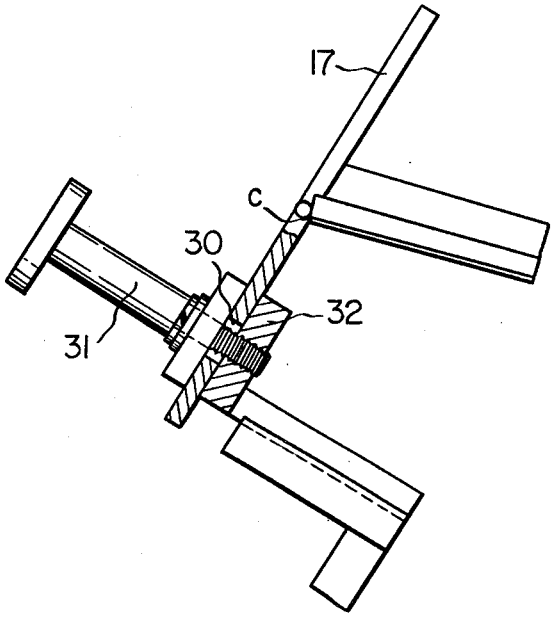
FIG. 4 is a cross sectional view of the lower part of the folding blade.
Figure 7:
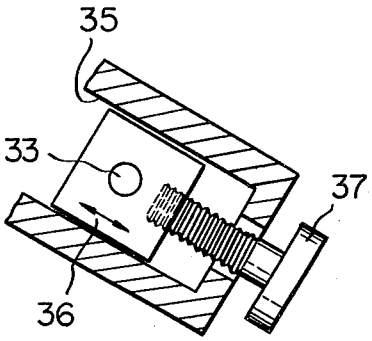
FIG. 7 is a cross sectional view of an adjustion device for the folding blade in the other embodiment of the present invention.
Figure 6:
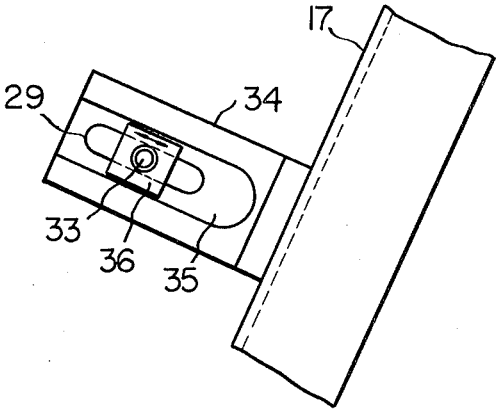
FIG. 6 is a bottom view of the upper part of the folding blade viewed from line VI—VI in FIG. 5.

As shown in FIG. 4, the lower part of the folding blade 17 is secured to the frame 32 of base 9 by a bolt 31 which is inserted through round hole 30 provided at the lower end of the folding blade 17. The upper part of the folding blade 17 is secured to a slider 36 by a bolt 33 which extends through slot 29 provided on from 34 attached to the base 9 as shown in FIG. 6. The slider 36 is slidably mounted in recess 35. As shown in FIG. 7, said slider 36 may be moved with adjusting screw 37.

As shown in FIG. 1, bag manufacturing device 40 is provided in front of the second guide roller 13.

The operation of said device is as follows: As shown in FIG. 1, film 2 (or sheet such as plastic) fed from film roll 4 in a forward direction is deflected in upper oblique direction at guide roller 12, runs along the lower face of folding plate 15, and is deflected again at the edges a, b in upper rear inclined direction toward the second folding roller 13. The left part **2*b* along the center folding line 2*a* in FIGS. 1, 2 runs under the folding blade 17 then over the edge d from the inclined edge b of folding plate 15 in a triangular shaped plane and is folded against the reverse side of the right half of film 2. Thus, film 2 is folded with the left part then being perfectly fed and passing under the rear side of the second guide roller 13**, and deflected in the forward direction.

As explained above, film is folded upon itself into a U-shape. In the above device, the only tensile force on the film is flattened by front edge a and inclined edge b of folding plate 15 along its whole length. Thus there is no concentration of force and the folding operation is performed precisely at the apex c, so that film is folded accurately without producing a crease in the case of very resilient film.

Figure 5:
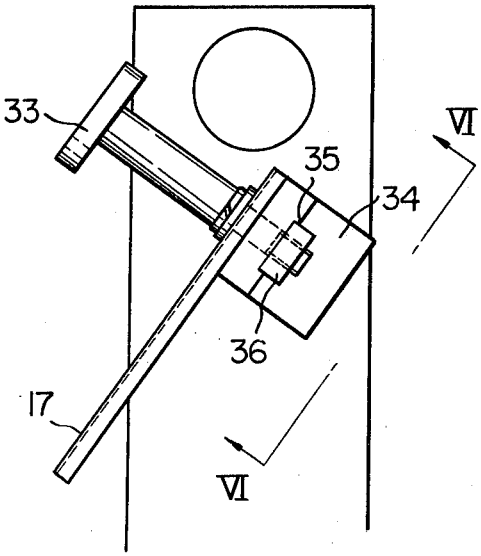
FIG. 5 is a side view of the upper part of the folding blade.

In said device, the oblique angle of the folding blade 17 is adjusted easily by loosening the securing bolts 31, 33 (FIGS. 4–6) and rotate adjusting bolt 37 to vary the position of slider 36. Therefore, it is possible to adjust the device to prevent the generation of any crease in film according to the variation of the thickness of film.

When the film is replaced by half size width film 3, the film 3 is guided above the second guide roller 13 from the roll 4, and fed to the bag manufacturing device 40 directly, as shown in FIG. 1.

As explained above, in the present invention, the direction for delivering film and feeding film are the same and mutually aligned. The device of the present invention includes a bag manufacturing device, a film winding machine and a slitter assembled in line and it is possible to save space and prevent the production of crease in film in the case of low quality film by adjusting the angle of the folding blade slightly from the normal position, fold the film accurately and to substitute half size film in width easily.

In the above embodiment, film is folded in a flat U shape, however it is possible to fold the film in a flat C shape by combining the teachings of the present invention with the triangle plate.

Figure 8:
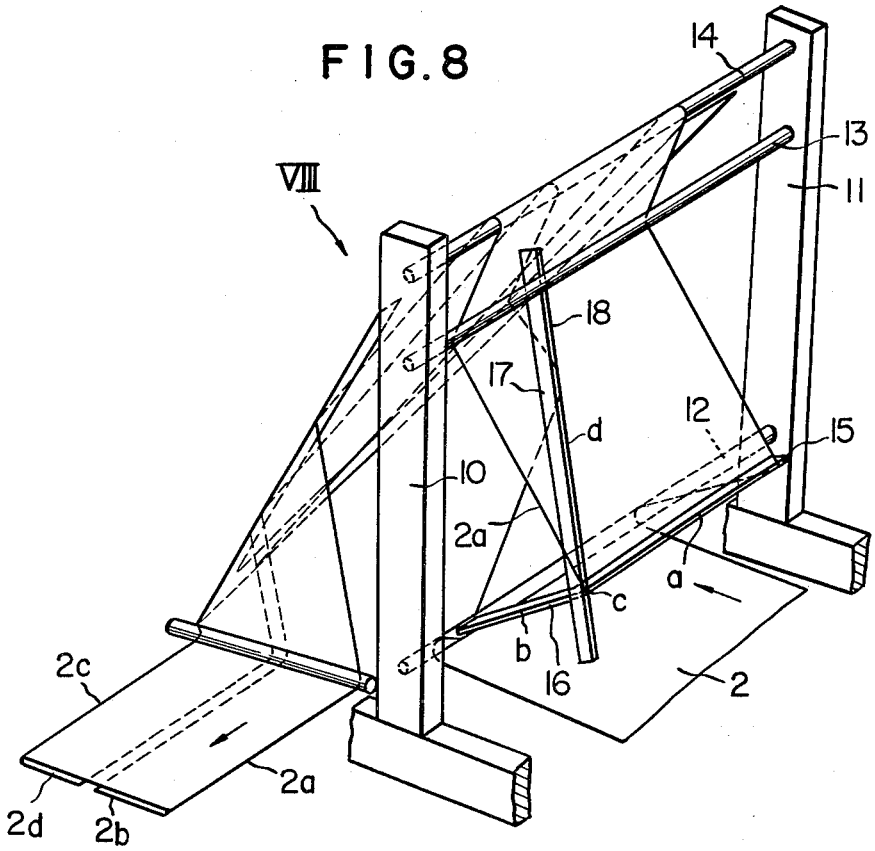
FIG. 8 is a perspective view of another embodiment of the present invention.
Figure 9:
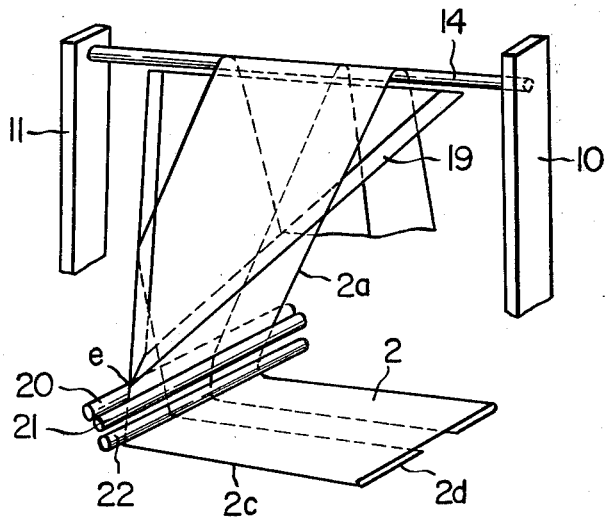
FIG. 9 is a perspective view taken at arrow VIII in FIG. 8.
Figure 10:
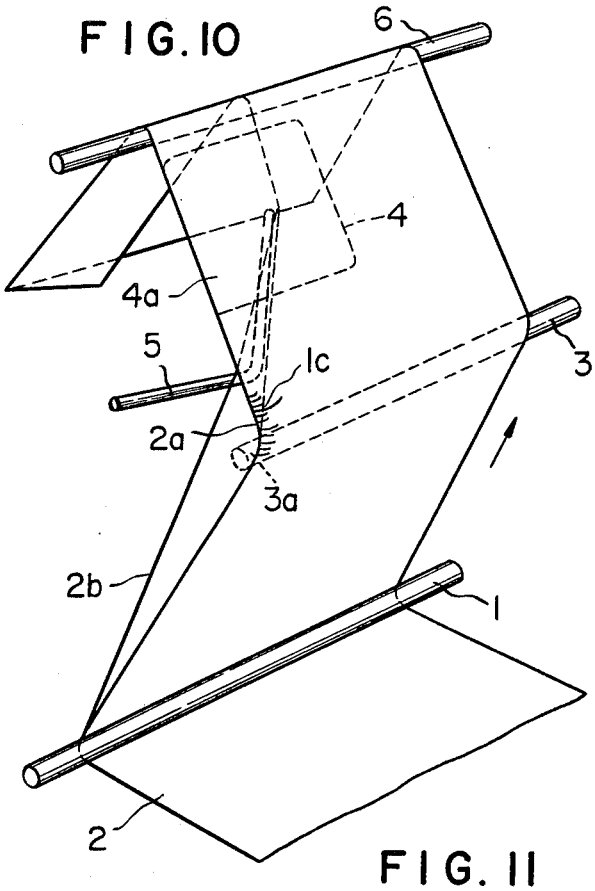
FIG. 10 is a perspective view of a prior art device.
Figure 11:
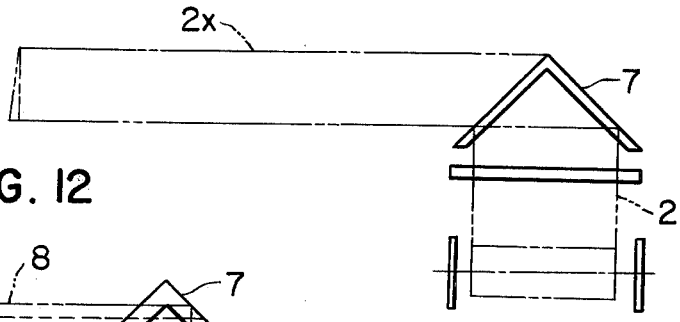
FIG. 11 is a plan view of another prior art device using triangle plate.
Figure 12:
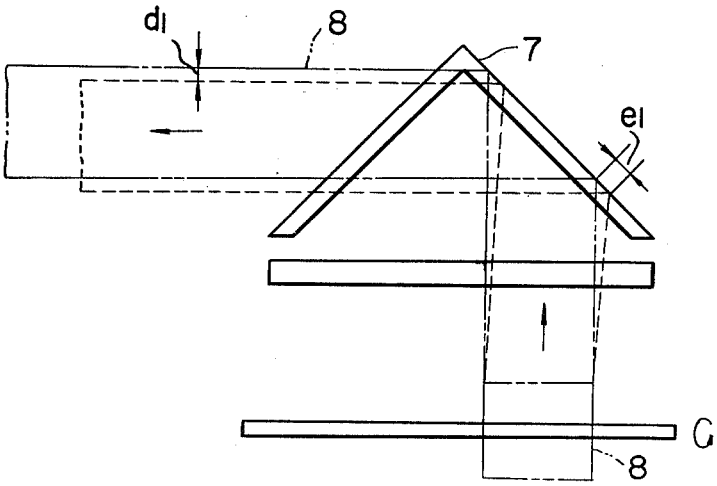
FIG. 12 is an enlarged plan view of the prior art device shown in FIG. 11.

FIGS. 8 and 9 show another embodiment of the present invention.

As shown in FIG. 8, first, second and third guide rollers 12, 13, 14 are provided between struts 10, 11. Folding plate 15 is fixed above the first guide roller 12 and extends in an oblique upper direction. The folding plate 15 is a knife shaped plate having front edge a and inclined edge b. The apex point c of the obtuse angle formed by said edges a, b opposes the folding line **2*a* of film 2. A rounded edge 16 is formed at the lower part of said edges a, b. Folding blade 17 is positioned beside point c of the folding plate 15 and extends in an oblique upward direction against and along the reverse side of the film 2 from the point c. The edge d of the folding blade extends in an inclined upward direction against the feeding direction of the film 2 and a round edge 18** is formed at the lower part of the edge d.

As shown in FIG. 9, triangular plate 19 is fixed at the other side of the third guide roller 14 and extends in an oblique downward direction. The apex e of the triangular plate 19 engages and opposes the secondary folding line **2*c* of the film 2**.

As shown in FIG. 9, a pair of idler rollers 20, 21 are provided under the triangular plate 19 and extends in a longitudinal direction with a guide roller 22 provided under the idler rollers 20, 21.

The operation of said device is as follows; as shown in FIG. 8, film 2 running in the direction shown is deflected by the first guide roller 12 in an oblique upward direction, and is fed along the lower face of folding plate 15. The film is then deflected in an oblique upward direction from the edges a, b, of the folding plate 15 toward the second guide roller 13. The outer part **2*b* from folding line 2*a* in film 2 runs along the edge d of the folding blade 17 from the apex c in the shape of triangle and is folded against the reverse side of film 2. Thus, the outer part 2*b* is perfectly folded and the folded film 2 passes over the rear side of said second guide roller 13 and is deflected in an upward oblique direction. The film 2 is then deflected in an oblique downward direction from the upper edge of the third guide roller 14, and passes along the upper face of the triangular plate 19, as shown in FIG. 9. The outer part 2*d* from folding line 2*c* is then folded against the reverse side of the film 2, then is guided by a pair of idler rollers 20, 21, deflected in a lateral direction under guide roller 22**.

As explained above, in the present invention, the film is folded in a flat U shape or flat C shape without producing excessive tensile force because the tensile force is received by the front edge and inclined edge of a folding plate along its width and the folding operation is performed accurately at the point c of a folding plate without producing a crease in the case of very resilient film.

I claim:

1. A film folding device for folding the film having an inner and outer surface comprising: film feed means for feeding said film in a predetermined direction to a film guide means; folding plate means for engaging and guiding the inner surface of said film and having a front edge extending traversely to the direction said film is being fed and an inclined edge extending in a direction oblique to said film feed direction, said front edge and inclined edge intersecting at an apex point and abutting the inner surface of said film in the direction being fed, separate film folding blade means for engaging and guiding the outer surface of said film and extending in a second direction oblique to said film feed direction and having an edge abutting the outer surface of said film adjacent to and spaced from said apex point whereby said film passes between the folding plate means and folding blade means and is folded along a fold line passing across said apex point with the inner surface of said film being inside.

2. A film folding device as claimed in claim 1 in which a round edge is provided on edges of said folding plate means in contact with said film.

3. A film folding device as claimed in claim 1 in which a round edge is provided on an edge of the folding blade means in contact with said film.

4. The film folding device according to claim 1 including means for adjusting tension on the film.

5. The film folding device according to claim 4 wherein the means for adjusting tension comprises adjusting means for adjusting the mounting position of the folding blade means.

6. The film folding device according to claim 1 wherein said folding blade means is adapted to fold approximately half of the film against itself.

7. The film folding device according to claim 6 including;

a triangular folding blade for receiving the half folded film;

said triangular blade receiving and folding the second half of said film against itself.

* * * * *